US012313076B2

(12) United States Patent
Cho et al.

(10) Patent No.: US 12,313,076 B2
(45) Date of Patent: May 27, 2025

(54) MULTISTAGE FLUID COMPRESSOR

(71) Applicant: Hanon Systems, Daejeon (KR)

(72) Inventors: Seong Kook Cho, Daejeon (KR); Ho Bin Im, Daejeon (KR)

(73) Assignee: HANON SYSTEMS, Daejeon (KR)

( * ) Notice: Subject to any disclaimer, the term of this patent is extended or adjusted under 35 U.S.C. 154(b) by 0 days.

(21) Appl. No.: 18/283,232

(22) PCT Filed: Mar. 17, 2022

(86) PCT No.: PCT/KR2022/003727

§ 371 (c)(1),
(2) Date: Sep. 21, 2023

(87) PCT Pub. No.: WO2022/234946

PCT Pub. Date: Nov. 10, 2022

(65) Prior Publication Data

US 2024/0167481 A1 May 23, 2024

(30) Foreign Application Priority Data

May 7, 2021 (KR) ..... 10-2021-0059002

(51) Int. Cl.
*F04D 17/12* (2006.01)
*F04D 25/06* (2006.01)
(Continued)

(52) U.S. Cl.
CPC ..... *F04D 17/12* (2013.01); *F04D 25/06* (2013.01); *F04D 25/0606* (2013.01); *F04D 29/056* (2013.01); *F04D 29/286* (2013.01)

(58) Field of Classification Search
CPC .... F04D 17/12; F04D 17/122; F04D 17/0513; F04D 17/286; F04D 17/5806;
(Continued)

(56) References Cited

U.S. PATENT DOCUMENTS

2017/0353070 A1* 12/2017 Im ..... H02K 3/345
2018/0231006 A1* 8/2018 Sun ..... F04D 25/06
(Continued)

FOREIGN PATENT DOCUMENTS

JP 2016102481 A 6/2016
JP 2016194252 A 11/2016
(Continued)

OTHER PUBLICATIONS

International Search Report issued in PCT/KR2022/003727 on Jun. 22, 2022.

*Primary Examiner* — Kenneth J Hansen
(74) *Attorney, Agent, or Firm* — NORTON ROSE FULBRIGHT US LLP

(57) ABSTRACT

The present invention relates to a multistage fluid compressor including a motor housing having a fluid injection port, a stator coupled to the inside of the motor housing, a rotor configured to penetrate the inside of the stator and having two opposite sides based on an axial direction, the two opposite sides being rotatably coupled to the motor housing, an impeller housing coupled to the motor housing and configured to communicate with the inside of the motor housing, the impeller housing having a fluid discharge port configured to connect the inside and outside thereof, and first and second impellers provided in the impeller housing and coupled to one end of the rotor, in which the compressor may be directly cooled by using a fluid intended to be compressed, and components of the compressor including a thrust bearing, the stator, and the rotor may be efficiently cooled.

13 Claims, 9 Drawing Sheets

(51) Int. Cl.
*F04D 29/056* (2006.01)
*F04D 29/28* (2006.01)

(58) Field of Classification Search
CPC ..... F04D 25/0606; H02K 3/28; H02K 5/161; H02K 5/1672; H02K 5/1732; H02K 7/083
See application file for complete search history.

(56) References Cited

U.S. PATENT DOCUMENTS

| | | | | |
|---|---|---|---|---|
| 2019/0055954 | A1* | 2/2019 | Egawa | F04D 29/057 |
| 2020/0366152 | A1* | 11/2020 | Lee | H02K 7/145 |

FOREIGN PATENT DOCUMENTS

| | | | |
|---|---|---|---|
| KR | 101184929 | B1 | 9/2012 |
| KR | 20140135383 | A | 11/2014 |
| KR | 20160008411 | A | 1/2016 |
| KR | 20190002972 | A | 1/2019 |

* cited by examiner

MULTISTAGE FLUID COMPRESSOR

CROSS REFERENCE TO RELATED APPLICATIONS

This patent application is a national phase under 35 U.S.C. § 371 of International Patent Application No. PCT/KR2022/003727 filed Mar. 17, 2022, which claims the benefit of priority from Korean Patent Application No. 10-2021-0059002 filed May 7, 2021, each of which is hereby incorporated herein by reference in its entirety for all purposes.

TECHNICAL FIELD

The present invention relates to a multistage fluid compressor in which impellers are provided in multiple stages in a compressor that compresses a fluid by using rotations of the impellers.

BACKGROUND ART

A fluid compressor refers to a mechanical device that generates energy of a fluid in order to raise pressure of the introduced fluid and supply the fluid by using an impeller that rotates.

In general, the fluid compressor has a high-speed motor that may be rotated at high speed by an inverter. An air foil journal bearing and an air foil thrust bearing are mounted and used to rotate a rotor at high speed.

The fluid compressor includes a main body configured to define an external appearance, a drive part including an impeller provided in the main body and configured to pressurize an introduced fluid, and a control part configured to control the drive part. The fluid compressor is configured such that the fluid, which is introduced into the main body through a fluid inlet port formed in the main body, is raised in pressure to a particular pressure or higher by the impeller and then discharged through a fluid discharge port.

In this case, because the fluid compressor rotates at a higher speed than a general motor, a large amount of heat is generated from the air foil bearings, and a large amount of heat is also generated from the rotor and a stator of the motor. Therefore, it is essential to cool the motor and the air foil bearings.

To this end, the fluid compressor in the related art has a cooling flow path structure for cooling the motor and the air foil bearings, but it is difficult for the cooling flow path structure to effectively cool the motor and the air foil bearings. Accordingly, there is a need for a cooling flow path structure capable of efficiently cooling the components in a fluid compressor.

DOCUMENT OF RELATED ART

Patent Document

KR 10-2014-0135383 A (Nov. 26, 2014)

DISCLOSURE

Technical Problem

The present invention has been made in an effort to solve the above-mentioned problem, and an object of the present invention is to provide a multistage fluid compressor capable of improving cooling efficiency by optimizing an arrangement of impellers and inlet and outlet flow path structures for a cooling medium and cooling a compressor by using a fluid intended to be compressed.

Technical Solution

To achieve the above-mentioned object, the present invention provides a multistage fluid compressor including: a motor housing having a fluid injection port formed at one side thereof and configured to communicate with the inside of the motor housing, the motor housing having an inlet flow path formed at one side thereof and configured to communicate with the fluid injection port, and a discharge flow path formed at the other side thereof and configured to communicate with the inside of the motor housing; a stator provided in the motor housing; a rotor provided in the motor housing and rotatably coupled to the motor housing; an impeller housing coupled to the other side of the motor housing, configured to communicate with the inside of the motor housing, and having a fluid discharge port through which a fluid is discharged; and first and second impellers provided in the impeller housing and coupled to the rotor.

In addition, the rotor may penetrate the inside of the stator, two opposite sides of the rotor based on an axial direction may be rotatably coupled to the motor housing by means of journal bearings, one end of the rotor based on the axial direction may be supported by thrust bearings, a side of the rotor adjacent to the thrust bearings may communicate with the inlet flow path of the motor housing, the impeller housing may communicate with the discharge flow path of the motor housing and have a fluid inlet and a fluid outlet that communicate with the inside of the impeller housing, and the impeller housing may have a connection flow path configured to connect the fluid inlet and the fluid outlet, and the fluid discharge port configured to connect the inside and outside thereof.

In addition, the fluid introduced into the fluid injection port of the motor housing may be divided, and a part of the divided fluid sequentially may pass over the thrust bearing and the journal bearing at one side based on the axial direction and flows toward the stator.

In addition, the fluid introduced into the fluid injection port of the motor housing may be divided, and a part of the divided fluid may flow between the stator and a bearing mounting portion at one side based on the axial direction.

In addition, a part of the fluid, which has been introduced into the fluid injection port of the motor housing and divided, may sequentially pass over the thrust bearing and the journal bearing at one side based on the axial direction and flow toward the stator, and the fluid having passed over the journal bearing at one side based on the axial direction may merge with the fluid introduced between the stator and the bearing mounting portion at one side based on the axial direction and flow along a gap between the stator and the rotor.

In addition, the fluid introduced into the fluid injection port of the motor housing may be divided, and a part of the divided fluid may flow between coils of the stator.

In addition, the fluid, which has been introduced into the fluid injection port of the motor housing and has passed through a gap between the stator and the rotor, may be divided, and a part of the divided fluid may pass over the journal bearing at the other side based on the axial direction and then flow to a fluid inlet at a side of the first impeller.

In addition, the fluid, which has been introduced into the fluid injection port of the motor housing and has passed through a gap between the stator and the rotor, may be divided, and a part of the divided fluid may merge with the fluid having passed between coils of the stator and then flow to a fluid inlet at a side of the first impeller through the discharge flow path of the motor housing.

In addition, the fluid introduced into a fluid inlet side of the impeller housing may be primarily raised in pressure while passing through the first impeller, sequentially pass over the connection flow path and a two-stage connection flow path of the impeller housing, and flow to a fluid inlet side of the second impeller.

In addition, the fluid introduced into the fluid inlet side of the second impeller may be secondarily raised in pressure while passing through the second impeller, sequentially pass over a two-stage volute and a fluid outlet of the impeller housing, and be discharged through the fluid discharge port.

In addition, the first and second impellers may be disposed coaxially in series in an axial direction of the rotor.

In addition, a thrust runner may be coupled to one end of the rotor based on an axial direction, and two opposite surfaces of the thrust runner based on the axial direction may be respectively supported by thrust bearings.

In addition, journal bearings may be respectively coupled to bearing mounting portions formed at two opposite sides of the motor housing based on an axial direction, the stator may have accommodation portions concavely formed radially inward at two opposite ends based on the axial direction, and the bearing mounting portions may be partially accommodated in the accommodation portions.

In addition, the stator may include a core, teeth, insulators configured to surround and insulate the core and the teeth, and coils wound around the teeth and disposed outside the insulators, and the accommodation portions may be formed in the insulators.

In addition, the multistage fluid compressor may further include: a cover coupled to one side of the motor housing and configured to define a space, in which a thrust runner and a thrust bearing are accommodated, by being coupled to the motor housing.

Advantageous Effects

The multistage fluid compressor of the present invention may improve the cooling efficiency by cooling the compressor by using the fluid to be compressed and optimizing the structure of the flow path in which the fluid flows.

In addition, it is possible to solve the problem in which the space occupied by the motor housing increases because of the outer diameter of the journal bearing. Further, a part of the journal bearing is inserted and disposed into the stator in the axial direction, which may reduce the overall axial length of the multistage fluid compressor.

MODE FOR INVENTION

Hereinafter, a multistage fluid compressor of the present invention configured as described above will be described in detail with reference to the accompanying drawings.

Figure 1:
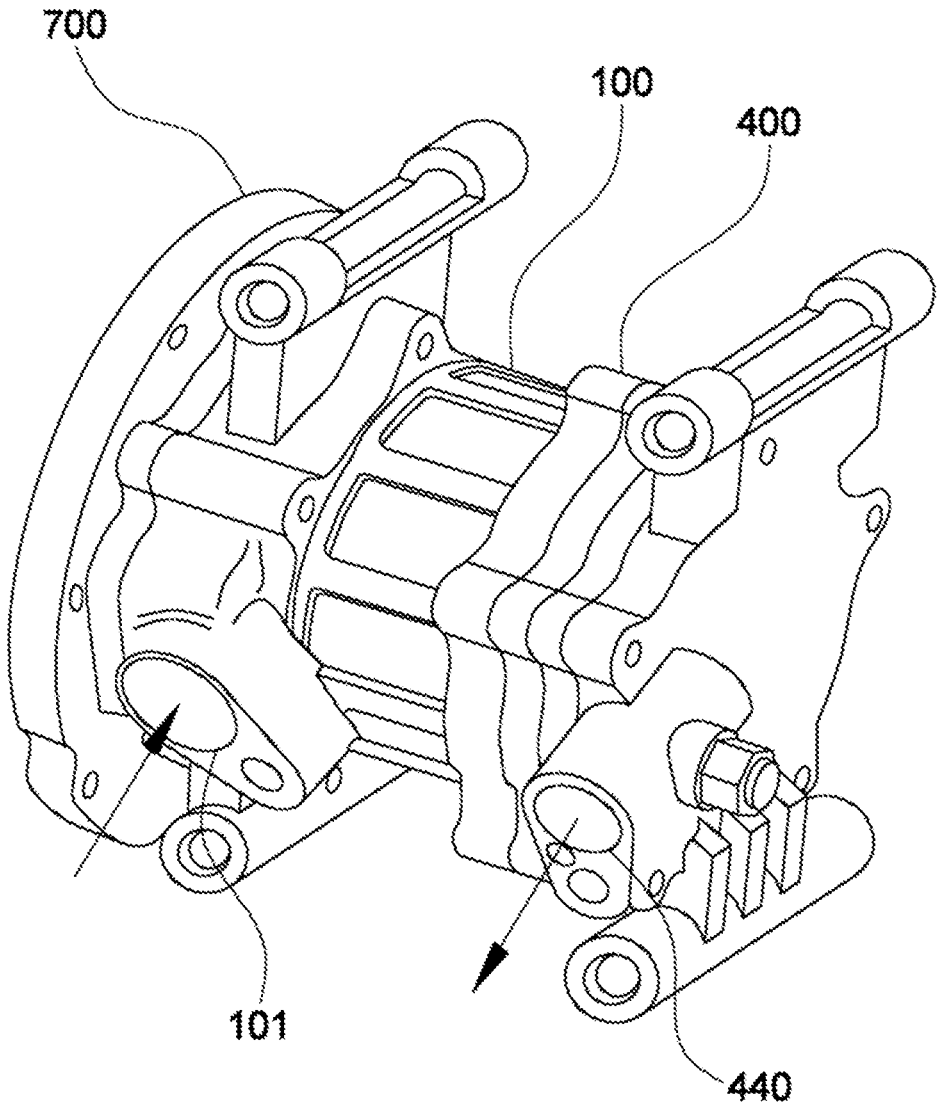
FIG. 1 is an assembled perspective view illustrating a multistage fluid compressor according to an embodiment of the present invention.
Figure 2:
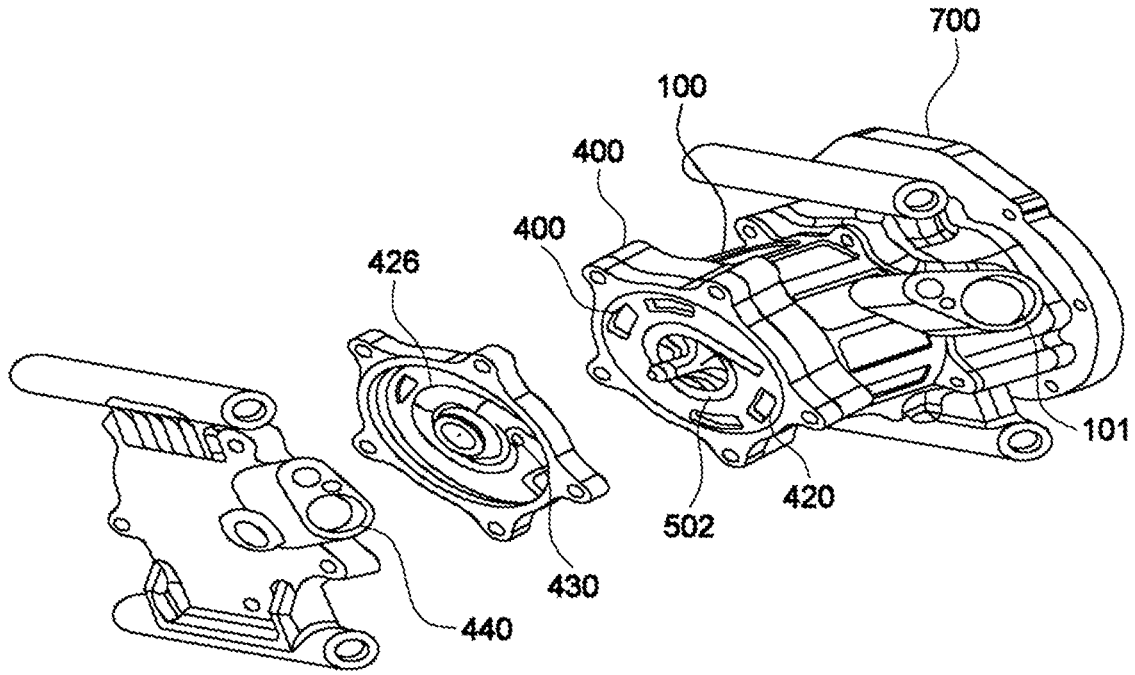
FIG. 2 is an exploded perspective view illustrating a multistage fluid compressor according to an embodiment of the present invention.
Figure 3:
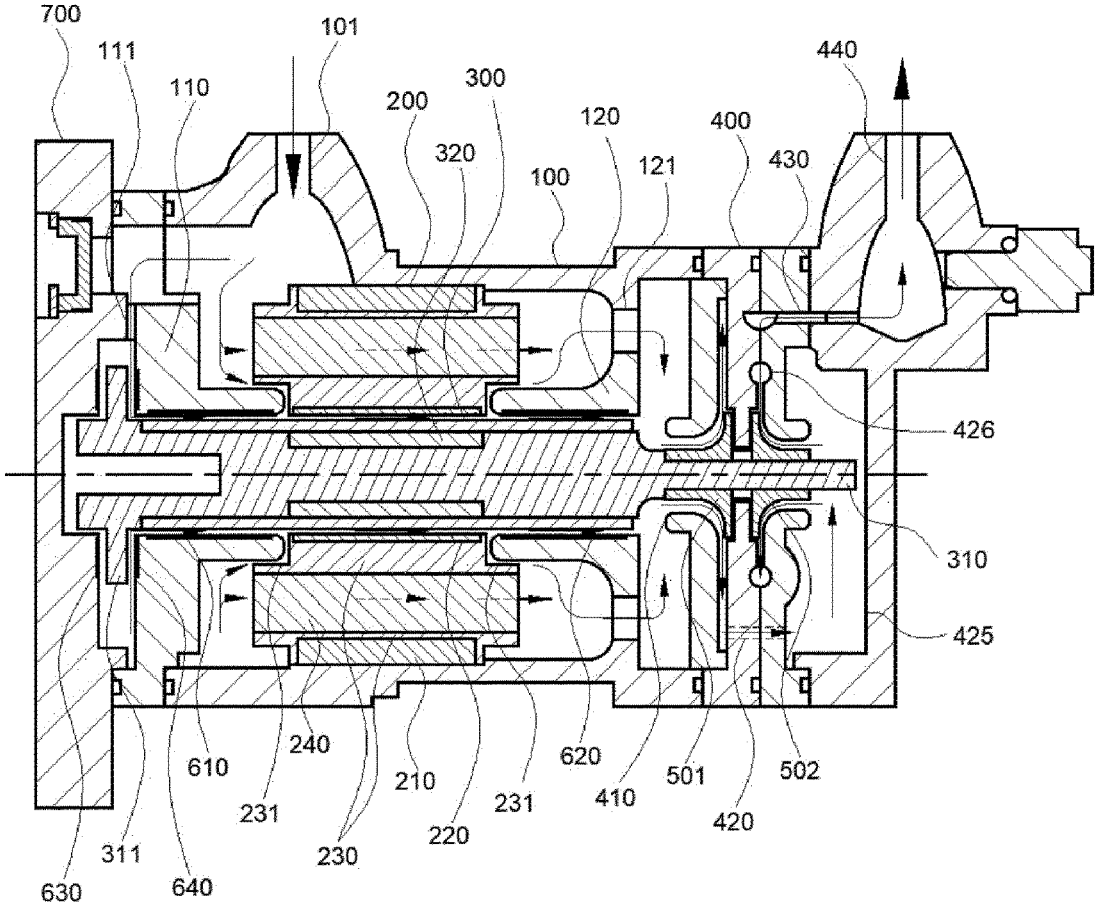
FIG. 3 is a front cross-sectional view illustrating a multistage fluid compressor according to an embodiment of the present invention.
Figure 4:
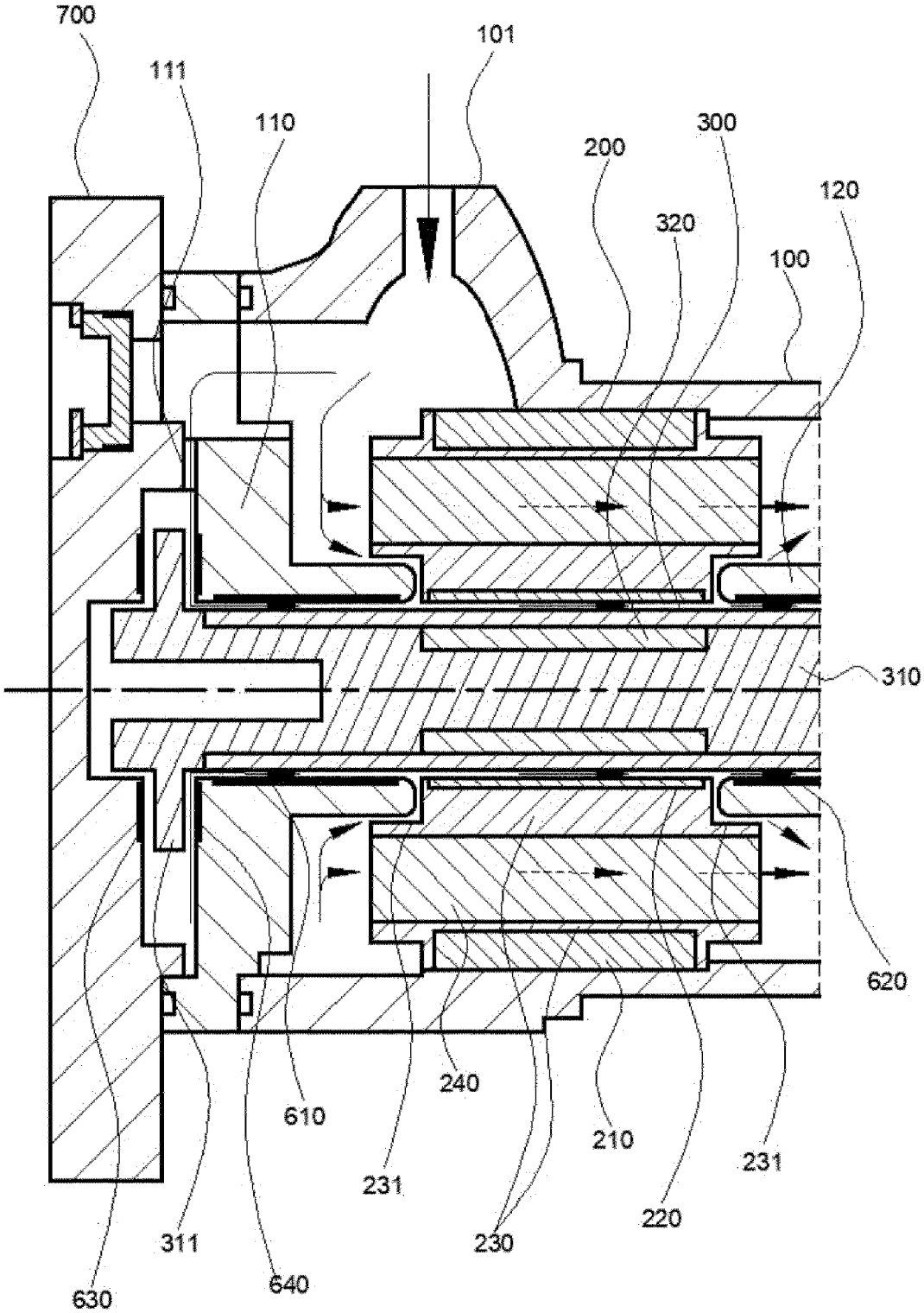
FIG. 4 is a partial cross-sectional view illustrating one side of the multistage fluid compressor according to the embodiment of the present invention.
Figure 5:
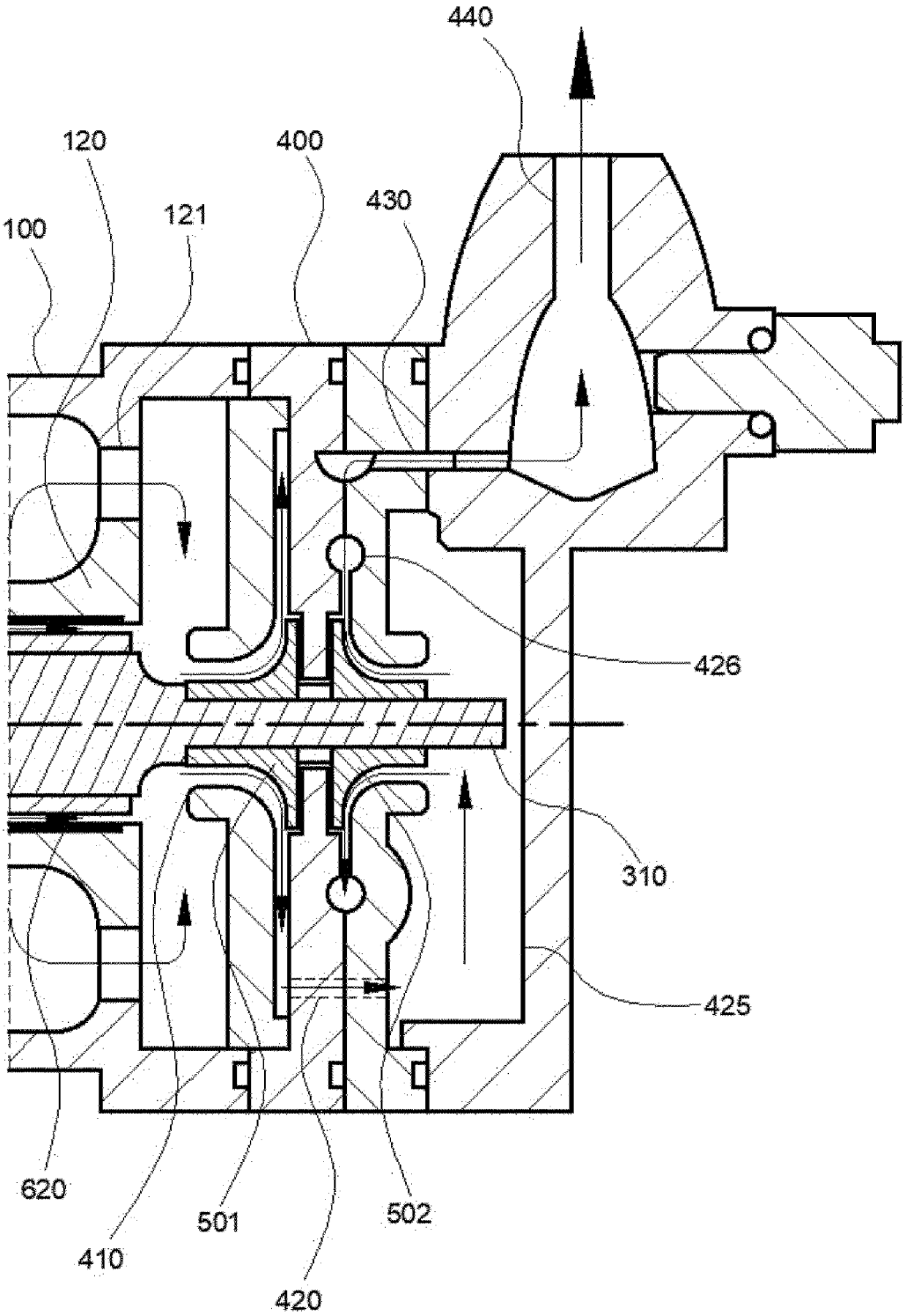
FIG. 5 is a partial cross-sectional view illustrating the other side of the multistage fluid compressor according to the embodiment of the present invention.
Figure 6:
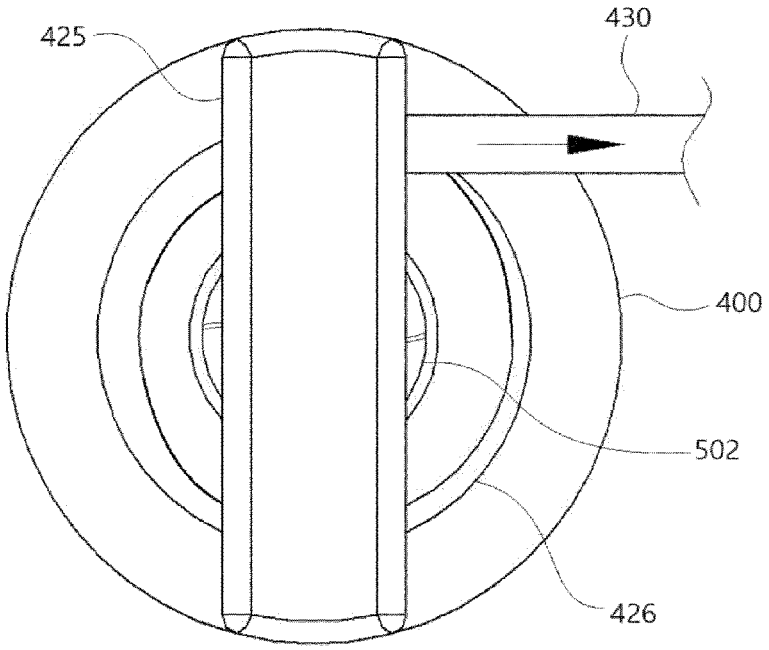
FIG. 6 is a lateral conceptual view illustrating a fluid flow path structure at a side of a second stage in which a second impeller of the multistage fluid compressor according to the embodiment of the present invention is disposed.
Figure 7:
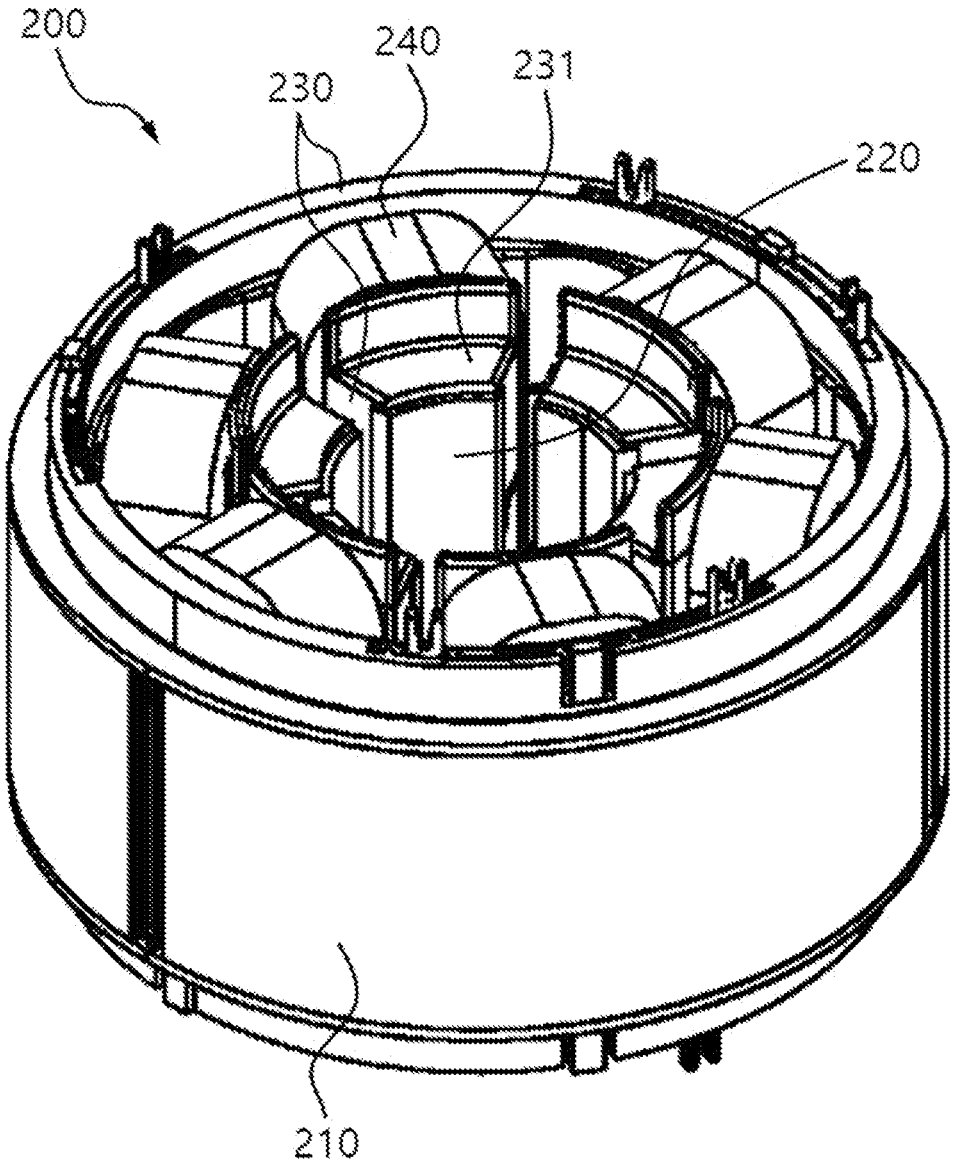
FIG. 7 is a perspective view illustrating a stator of the multistage fluid compressor according to the embodiment of the present invention.

FIGS. 1 to 3 are an assembled perspective view, an exploded perspective view, and a front cross-sectional view illustrating a multistage fluid compressor according to an embodiment of the present invention, FIGS. 4 and 5 are partial cross-sectional views illustrating one side and the other side of the multistage fluid compressor according to the embodiment of the present invention, FIG. 6 is a lateral conceptual view illustrating a fluid flow path structure at a side of a second stage in which a second impeller of the multistage fluid compressor according to the embodiment of the present invention is disposed, and FIG. 7 is a perspective view illustrating a stator of the multistage fluid compressor according to the embodiment of the present invention.

As illustrated, the multistage fluid compressor according to the embodiment of the present invention may broadly include a motor housing 100, a stator 200, a rotor 300, an impeller housing 400, a first impeller 501, and a second impeller 502 and further include a cover 700.

The motor housing 100 may be a part for defining an external shape of the compressor and include a pair of bearing mounting portions 110 and 120 formed at two opposite ends of a body based on a direction of a central axis of the body. The body of the motor housing 100 may have a hollow portion therein and be formed in an approximately cylindrical shape opened at two opposite ends based on the direction of the central axis. Further, for example, one bearing mounting portion 110 may be coupled to one end of the body, and the other bearing mounting portion 120 may be integrated with the other end of the body. In addition, the bearing mounting portions 110 and 120 may be formed to cover and close the two opposite open ends of the body and respectively have holes provided at centers thereof and formed through two opposite surfaces thereof. Therefore, journal bearings 610 and 620 may be respectively inserted and mounted into the holes of the bearing mounting portions 110 and 120. In this case, the journal bearings 610 and 620 may be air foil journal bearings configured to allow a rotor 300 to be floated by air pressure when the rotor 300 rotates. In addition, a fluid injection port 101 may be formed at one side of the motor housing 100 and communicate with the inside of the motor housing 100, such that a fluid may be introduced into the motor housing 100 through the fluid injection port 101. An inlet flow path 111 may be formed in the bearing mounting portion 110 disposed at one side of the motor housing 100 and communicate with the fluid injection port 101. In this case, the fluid, which is introduced into the motor housing 100 through the fluid injection port 101 may be a refrigerant, for example.

The stator 200 may be provided in the motor housing 100. The stator 200 may be fixed to adjoin an inner peripheral surface of the motor housing 100. Further, the stator 200 may be formed in a shape having a central portion formed through two opposite surfaces thereof in the direction of the central axis. In addition, the stator 200 may include a core 210, teeth 220, insulators 230, and coils 240. The core 210 is formed in a cylindrical shape. The plurality of teeth 220 may radially extend toward the central axis from an inner peripheral surface of the core 210. Further, pole shoes may extend from radially inner ends of the teeth 220 toward two opposite sides based on a circumferential direction. In addition, the adjacent teeth 220 may be spaced apart from one another, and the adjacent pole shoes may be spaced apart from one another. The insulators 230 may surround and insulate the core 210 and the teeth 220. An outer peripheral surface of the core 210 and inner peripheral surfaces of the teeth 220 may be exposed to the outside of the insulators 230. The coil 240 may be wound around the teeth 220 and disposed outside the insulator 230. The adjacent coils 240 are spaced apart from one another in the circumferential direction, such that spaces, in which the fluid may flow, may be defined between the coils 240. In addition, the insulator 230 may have an accommodation portion 231 concavely formed radially inward at two opposite ends based on the axial direction. The coil 240 may be disposed outside the accommodation portion 231 in the radial direction. Therefore, the bearing mounting portions 110 and 120, on which the journal bearings 610 and 620 are mounted, may be partially inserted and accommodated into the accommodation portions 231 of the stator 200.

The rotor 300 may be disposed to be penetratively inserted into the central portion of the stator 200, and the rotor 300 may be disposed to be spaced apart from the inside of the stator 200. Further, the rotor 300 may include a rotary shaft 310, a thrust runner 311, and magnets 320. The magnets 320 may be disposed at positions between two opposite sides of the rotary shaft 310 based on the axial direction of the rotary shaft 310, such that the magnets 320 may be positioned at positions corresponding to the stator 200. In addition, one side of the rotary shaft 310 based on the axial direction may be inserted into and rotatably supported on one journal bearing 610, and the other side of the rotary shaft 310 based on the axial direction may be inserted into and rotatably supported on the other journal bearing 620. Therefore, the rotor 300 may be supported in the radial direction by the pair of journal bearings 610 and 620. The thrust runner 311 may be disposed at one end of the rotary shaft 310 based on the axial direction, and the thrust runner 311 may be integrated with the rotary shaft and rotate together with the rotary shaft 310. Further, the thrust runner 311 may be formed in a circular plate shape and disposed outside the motor housing 100. In addition, the cover 700 may be coupled to one side of the motor housing 100, and the thrust runner 311 may be accommodated in an internal space defined by coupling the motor housing 100 and the cover 700. Further, one thrust bearing 630 may be interposed between the thrust runner 311 and the cover 700 in the axial direction, and the other thrust bearing 640 may be interposed between the thrust runner 311 and the bearing mounting portion 110 facing the thrust runner 311. Therefore, the rotor 300 may be supported in the axial direction by the pair of thrust bearings 630 and 640 and the thrust runner 311. In this case, the thrust bearings 630 and 640 may be air foil thrust bearings configured to allow the rotor to be floated by air pressure when the rotor 300 rotates.

The impeller housing 400 may be coupled to the other side of the motor housing 100. The impellers 501 and 502 may be disposed in an internal space defined by coupling the impeller housing 400 and the motor housing 100. Further, the impeller housing 400 may communicate with a discharge flow path 121 of the motor housing 100. In addition, the impeller housing 400 may have a fluid inlet 410 and a fluid outlet 430 to communicate with the inside of the impeller housing 400 and have a connection flow path 420 that connects the fluid inlet 410 and the fluid outlet 430. In addition, the impeller housing 400 has a fluid discharge port 401 that communicates with the inside of the impeller housing 400. The fluid with raised pressure may be discharged to the outside from the inside of the impeller housing 400 through the fluid discharge port 401.

The first impeller 501 and the second impeller 502 may be provided in the impeller housing 400, the first impeller 501 may be disposed at a side of the fluid inlet 410 of the impeller housing 400, and the second impeller 502 may be disposed at a side of the fluid outlet 430 of the impeller housing 400. Further, the first impeller 501 and the second impeller 502 may be coupled to the other end of the rotary shaft 310 of the rotor 300, such that the first impeller 501 and the second impeller 502 may rotate together with the rotor 300. In addition, the first impeller 501 and the second impeller 502 may be disposed coaxially in series in the axial direction of the rotor 300 and disposed adjacent to and spaced apart from each other. A fluid inlet side of the first impeller 501 may be disposed at the side of the fluid inlet 410 of the impeller housing 400, and a fluid outlet side of the second impeller 502 may be disposed at the side of the fluid outlet 430 of the impeller housing 400. In this case, the impellers provided in the two stages are illustrated. However, the impellers may be provided in two or more stages. In addition, for example, the first impeller 501 and the second impeller 502 may be centrifugal impellers configured such that the fluid is introduced into the impeller in the axial direction and discharged to the outside in the radial direction.

Therefore, when the rotor 300 rotates, the first impeller 501 and the second impeller 502 may rotate together, and a gas-phase fluid may be introduced into the motor housing 100 through the fluid injection port 101 of the motor housing 100 by the rotations of the first and second impellers 501 and 502. Further, the fluid, which is introduced into the motor housing 100, may be divided, and a part of the fluid may flow through the inlet flow path 111 to the space in which the thrust runner 311 is disposed. The fluid, which is introduced into the thrust runner 311, may sequentially pass over the thrust bearing 640, the journal bearing 610, the gap between the stator 200 and the rotor 300, and the journal bearing 620 and flow to the fluid inlet 410 of the impeller housing 400. Further, the remaining part of the divided fluid may pass through the portion between the coils 240 of the stator 200 and the portion between the stator 200 and the rotor 300 and then flow to the fluid inlet 410 of the impeller housing 400 via the discharge flow path 121 of the motor housing 100. In addition, the fluid may be primarily raised in pressure while passing through the first impeller 501 at the side of the fluid inlet 410 of the impeller housing 400, and then the fluid may sequentially pass over the connection flow path 420 and a two-stage connection flow path 425 and flow to the fluid inlet side of the second impeller 502. Thereafter, the fluid is secondarily raised in pressure while passing through the second impeller 502, and then the fluid may sequentially pass over a two-stage volute 426 and the fluid outlet 430 and be discharged through a fluid discharge port 440, such that the compressed fluid may flow to a desired location.

Therefore, the multistage fluid compressor according to the embodiment of the present invention is configured to cool, first, the thrust bearing, the journal bearing, the stator, and the rotor, which generate heat in the multistage fluid compressor, by using the fluid intended to be compressed, compress the fluid in the impellers, and then discharge the fluid. Therefore, the efficiency in cooling the heat generating components is improved, and a separate cooling medium is not required.

Further, because the impellers are provided in multiple stages, the length of the multistage fluid compressor in the axial direction may be relatively long. In contrast, in the present invention, the bearing mounting portions 110 and 120, on which the journal bearings 610 and 620 are mounted, are disposed to be partially inserted into the accommodation portions 231 concavely formed radially inward at the two opposite sides of the insulators 230 of the stator 200 based on the axial direction. Therefore, the bearing mounting portions 110 and 120 may be partially disposed inside two opposite end turns of the coil 240 of the stator 200 based on the axial direction. Therefore, the axial length of the multistage fluid compressor may be reduced, which may implement the compact configuration.

Figure 8:
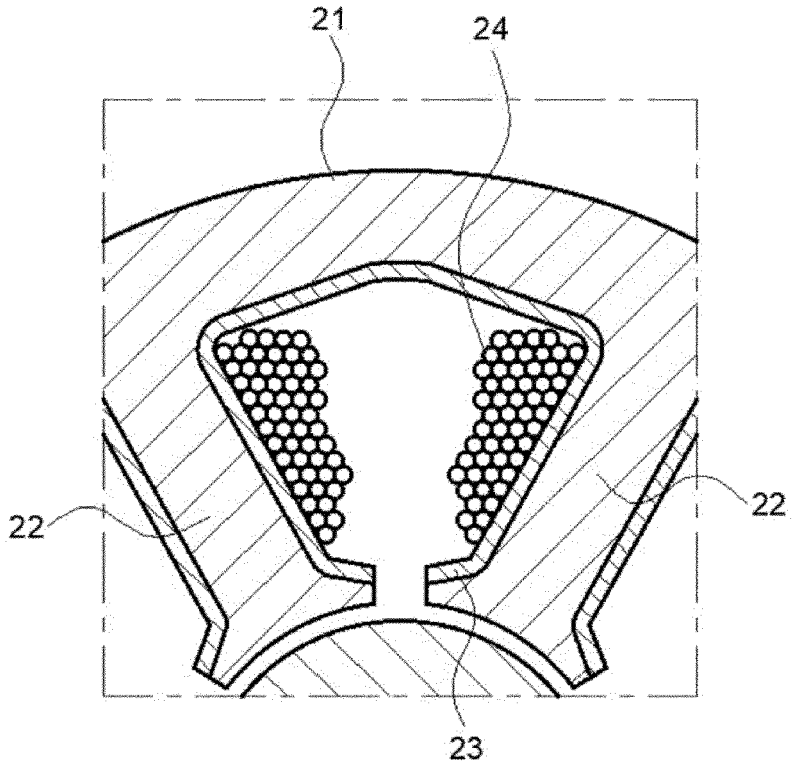
FIG. 8 is a top cross-sectional view illustrating an arrangement of a coil in a stator in the related art.
Figure 9:
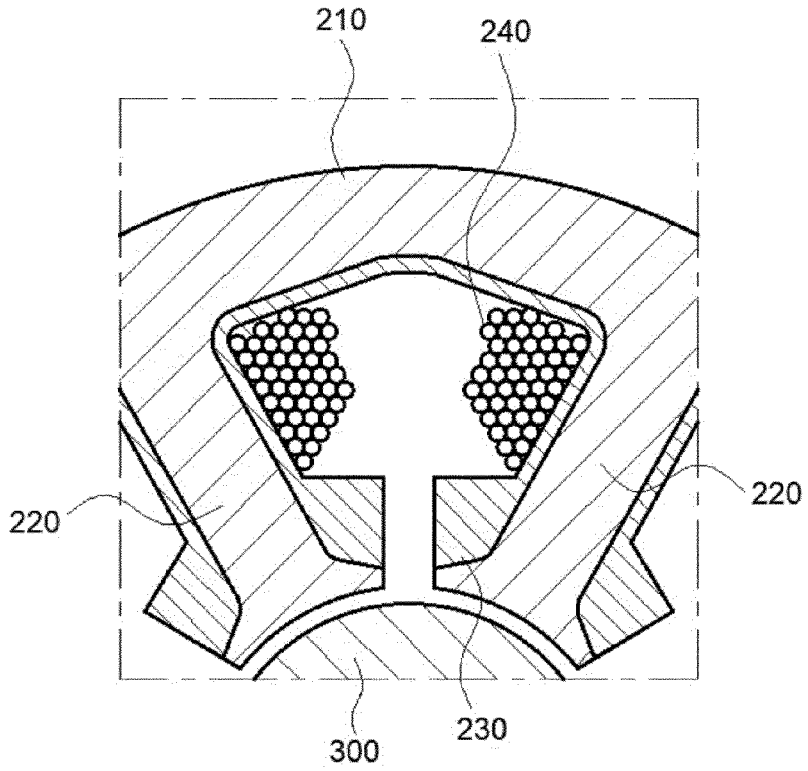
FIG. 9 is a top cross-sectional view illustrating an arrangement of a coil in the stator of the multistage fluid compressor according to the embodiment of the present invention.

FIGS. 8 and 9 are top cross-sectional views illustrating an arrangement of a coil in a stator in the related art and an arrangement of the coil in the stator of the multistage fluid compressor according to the present invention.

As illustrated in FIG. 8, in the related art, a core 21 and teeth 22 of the stator are surrounded by an insulator 23, and a coil 24 is disposed from a portion adjacent to the core 21 in the radial direction to inner ends of the teeth 22, such that wires of the coil 24 are relatively dispersed and wound. In contrast, it can be seen that in the present invention illustrated in FIG. 9, a thickness of the insulator 230 adjacent to the inner ends of the teeth 220 is relatively large, the coil 240 is relatively further distant from the rotor 300, and wires of the coil 240 are wound relatively concentratedly. Therefore, in the present invention, the coil is wound relatively concentratedly, which makes it possible to reduce an eddy current loss and an AC copper loss when an alternating current is used. In addition, it is possible to reduce the amount of heat generated from the stator, thereby improving the performance of the multistage fluid compressor.

The present invention is not limited to the above embodiments, and the scope of application is diverse. Of course, various modifications and implementations made by any person skilled in the art to which the present invention pertains without departing from the subject matter of the present invention claimed in the claims.

DESCRIPTION OF REFERENCE NUMERALS

100: Motor housing
101: Fluid injection port
110: Bearing mounting portion
111: Inlet flow path
120: Bearing mounting portion
121: Discharge flow path
200: Stator
210: Core
220: Tooth
230: Insulator
231: Accommodation portion
240: Coil
300: Rotor
310: Rotary shaft
311: Thrust runner
320: Magnet
400: Impeller housing
401: Fluid discharge port
410: Fluid inlet
420: Connection flow path
425: Two-stage connection flow path
426: Two-stage volute
430: Fluid outlet
440: Fluid discharge port
501: First impeller
502: Second impeller
610, 620: Journal bearing
630, 640: Thrust bearing
700: Cover

What is claimed is:

1. A multistage fluid compressor comprising:

a motor housing having a fluid injection port formed at one side thereof and configured to communicate with the inside of the motor housing, the motor housing having an inlet flow path formed at one side thereof and configured to communicate with the fluid injection port, and a discharge flow path formed at the other side thereof and configured to communicate with the inside of the motor housing;

a stator provided in the motor housing;

a rotor provided in the motor housing and rotatably coupled to the motor housing;

an impeller housing coupled to the other side of the motor housing, configured to communicate with the inside of the motor housing, and having a fluid discharge port through which a fluid is discharged; and first and second impellers provided in the impeller housing and coupled to the rotor, wherein journal bearings are respectively coupled to bearing mounting portions formed at two opposite sides of the motor housing based on an axial direction, the stator has accommodation portions concavely formed radially inward at two opposite ends based on the axial direction, and the bearing mounting portions are partially accommodated in the accommodation portions, and wherein the stator comprises a core, teeth, insulators configured to surround and insulate the core and the teeth, and coils wound around the teeth and disposed outside the insulators, and the accommodation portions are formed in the insulators.

2. The multistage fluid compressor of claim 1, wherein the rotor penetrates the inside of the stator, two opposite sides of the rotor based on an axial direction are rotatably coupled to the motor housing by means of journal bearings, one end of the rotor based on the axial direction is supported by thrust bearings, and a side of the rotor adjacent to the thrust bearings communicates with the inlet flow path of the motor housing, and wherein the impeller housing communicates with the discharge flow path of the motor housing and has a fluid inlet and a fluid outlet that communicate with the inside of the impeller housing, and the impeller housing has a connection flow path configured to connect the fluid inlet and the fluid outlet, and the fluid discharge port configured to connect the inside and outside thereof.

3. The multistage fluid compressor of claim 2, wherein the fluid introduced into the fluid injection port of the motor housing is divided, and a part of the divided fluid sequentially passes over the thrust bearing and the journal bearing at one side based on the axial direction and flows toward the stator.

4. The multistage fluid compressor of claim 2, wherein the fluid introduced into the fluid injection port of the motor housing is divided, and a part of the divided fluid flows between the stator and a bearing mounting portion at one side based on the axial direction.

5. The multistage fluid compressor of claim 4, wherein a part of the fluid, which has been introduced into the fluid injection port of the motor housing and divided, sequentially passes over the thrust bearing and the journal bearing at one side based on the axial direction and flows toward the stator, and wherein the fluid having passed over the journal bearing at one side based on the axial direction merges with the fluid introduced between the stator and the bearing mounting portion at one side based on the axial direction and flows along a gap between the stator and the rotor.

6. The multistage fluid compressor of claim 2, wherein the fluid introduced into the fluid injection port of the motor housing is divided, and a part of the divided fluid flows between coils of the stator.

7. The multistage fluid compressor of claim 2, wherein the fluid, which has been introduced into the fluid injection port of the motor housing and has passed through a gap between the stator and the rotor, is divided, and a part of the divided fluid passes over the journal bearing at the other side based on the axial direction and then flows to a fluid inlet at a side of the first impeller.

8. The multistage fluid compressor of claim 2, wherein the fluid, which has been introduced into the fluid injection port of the motor housing and has passed through a gap between the stator and the rotor, is divided, and a part of the divided fluid merges with the fluid having passed between coils of the stator and then flows to a fluid inlet at a side of the first impeller through the discharge flow path of the motor housing.

9. The multistage fluid compressor of claim 2, wherein the fluid introduced into a fluid inlet side of the impeller housing is primarily raised in pressure while passing through the first impeller, sequentially passes over the connection flow path and a two-stage connection flow path of the impeller housing, and flows to a fluid inlet side of the second impeller.

10. The multistage fluid compressor of claim 9, wherein the fluid introduced into the fluid inlet side of the second impeller is secondarily raised in pressure while passing through the second impeller, sequentially passes over a two-stage volute and a fluid outlet of the impeller housing, and is discharged through the fluid discharge port.

11. The multistage fluid compressor of claim 1, wherein the first and second impellers are disposed coaxially in series in an axial direction of the rotor.

12. The multistage fluid compressor of claim 1, wherein a thrust runner is coupled to one end of the rotor based on an axial direction, and two opposite surfaces of the thrust runner based on the axial direction are respectively supported by thrust bearings.

13. The multistage fluid compressor of claim 1, further comprising:

a cover coupled to one side of the motor housing and configured to define a space, in which a thrust runner and a thrust bearing are accommodated, by being coupled to the motor housing.

* * * * *